US006418909B2

(12) United States Patent
Rossi et al.

(10) Patent No.: US 6,418,909 B2
(45) **Date of Patent: *Jul. 16, 2002**

(54) LOW COST HYDRAULIC DAMPER ELEMENT AND METHOD FOR PRODUCING THE SAME

(75) Inventors: Paul L. Rossi, Waterford; Kenneth O. Jahr, West Bloomfield; William T. Harvey, Brighton; Shari F. Stottler, Milford; Kevin A. Grabowski, Brighton; Dewey McKinley Sims, Jr., Wayne, all of MI (US); Helmut G. Schwegler, Pleidelsheim; Wolfgang B. Weinbrecht, Pforzheim, both of (DE)

(73) Assignee: Robert Bosch Corporation, Broadview, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/449,710

(22) Filed: Nov. 24, 1999

Related U.S. Application Data

(60) Provisional application No. 60/109,632, filed on Nov. 24, 1998.

(51) Int. Cl.[7] ..... F02M 41/00
(52) U.S. Cl. ..... 123/456; 123/447
(58) Field of Search ..... 123/468, 456, 123/457, 447, 469, 470; 138/26, 30, 28

(56) References Cited

U.S. PATENT DOCUMENTS

| | | | | |
|---|---|---|---|---|
| 1,058,572 A | | 4/1913 | Finlay | 138/28 |
| 2,530,190 A | * | 11/1950 | Carver | 138/26 |
| 2,599,325 A | | 6/1952 | Fritzberg | 138/28 |
| 3,154,037 A | * | 10/1964 | Mayrath | 72/52 |
| 3,227,147 A | | 1/1966 | Gossiaux | 123/468 |
| 4,056,679 A | | 11/1977 | Brandt et al. | 174/13 |
| 4,295,452 A | | 10/1981 | Lembke et al. | 123/470 |
| 4,649,884 A | | 3/1987 | Tuckey | 123/457 |
| 4,651,781 A | | 3/1987 | Kandelman | 138/30 |
| 4,660,524 A | | 4/1987 | Bertsch et al. | 123/468 |
| 4,782,570 A | * | 11/1988 | Spridco | 29/157 |
| 4,861,238 A | | 8/1989 | Kamiyama et al. | |
| 5,024,198 A | | 6/1991 | Usui | 123/468 |
| 5,058,627 A | | 10/1991 | Brannen | 138/27 |
| 5,374,169 A | | 12/1994 | Talaski | 417/540 |
| 5,538,043 A | | 7/1996 | Salazar | 138/26 |
| 5,570,762 A | | 11/1996 | Jentsch et al. | 188/322.15 |
| 5,575,262 A | | 11/1996 | Rohde | 123/467 |
| 5,607,035 A | | 3/1997 | Fulks et al. | 188/322.19 |
| 5,617,827 A | | 4/1997 | Eshleman et al. | 123/456 |
| 5,620,172 A | | 4/1997 | Fulks et al. | 267/221 |
| 5,645,127 A | * | 7/1997 | Enderle et al. | 165/176 |
| 5,687,958 A | | 11/1997 | Renz et al. | 267/136 |
| 5,845,621 A | * | 12/1998 | Robinson et al. | 123/456 |
| 5,896,843 A | | 4/1999 | Lorraine | |
| 6,205,979 B1 | * | 5/2001 | Sims, Jr. et al. | 123/456 |

FOREIGN PATENT DOCUMENTS

| | | |
|---|---|---|
| DE | 3842298 A1 | 6/1990 |
| GB | 890895 | 3/1962 |
| WO | WO01/07776 A1 | 2/2001 |

* cited by examiner

*Primary Examiner*—Willis R. Wolfe
*Assistant Examiner*—Mahmoud Gimie
(74) *Attorney, Agent, or Firm*—Michael Best & Friedrich LLP

(57) ABSTRACT

A hydraulic pressure damper element is manufactured by shaping a stainless steel tube; flattened each end of the tube; and sealing a gas within the tube. Wire retaining devices may also be attached to the ends of the damper in order to support the device within a fuel rail tube in a fuel system.

20 Claims, 3 Drawing Sheets

LOW COST HYDRAULIC DAMPER ELEMENT AND METHOD FOR PRODUCING THE SAME

RELATED APPLICATION

This application claims the benefit of U.S. Provisional Application No. 60/109,632, filed Nov. 24, 1998.

FIELD OF THE INVENTION

The present invention relates to a damper element for damping pressure pulsations in vehicle fuel systems.

BACKGROUND

In gasoline fuel injection systems, such as manifold injection systems, pressure pulsations within the fuel system can cause various problems. For example, internal pressure pulsations within a fuel rail tube of an automotive gas multi-port fuel injection system can result in audible noise, and can adversely affect tailpipe emissions and driveability. Various solutions have been proposed to solve these problems including conventional diaphragm dampers.

SUMMARY OF THE INVENTION

The present invention provides a low-cost damper element which has good durability even in environments in which it is exposed to fuel and fluctuating temperatures. The damper element damps pressure pulsations in a flow discharge medium. Preferably, the damper element is employed to damp pressure pulsations in a fuel system such as in fuel rails of internal combustion engines.

The invention also provides a simple method of manufacturing the damper. The method includes shaping and sealing a metallic tube. More specifically, the method includes the steps of: rolling a ribbon of metal into a tube; welding the longitudinal seam; and sealing the ends.

Preferably, the tube initially has a circular cross-section, and is formed into a desired cross-section, such as oval or rectangular, after the longitudinal seam is in place. Preferably, the tube is cut to a desired length, the ends are flattened, and then the ends are sealed by laser or resistance welding. Preferably, wire support members are clipped onto the flattened ends of the tube. Alternatively, the wire support members are welded or brazed to the flattened ends of the tube. The wire supports can include stainless steel wire. If brazing is used, the wire support members can include copper-coated stainless steel wire, and the copper coating may be used as the braze media. Preferably, a gas is introduced into the interior of the tube before flattening and sealing the ends of the tube.

A damper element formed by the above method may be made from a single piece of metal and preferably has a longitudinal seam along only one side of the damper element. The method is generally less expensive than prior art methods for making a clam-shell type damper element. Such prior art methods generally include welding two pieces of metal together and forming a seam around the entire perimeter of the damper element. Also, the damper element of the present invention is generally less prone to failure due to the single longitudinal seam.

Other features and advantages of the invention will become apparent to those skilled in the art upon review of the following detailed description, claims, and drawings.

Figure 1:
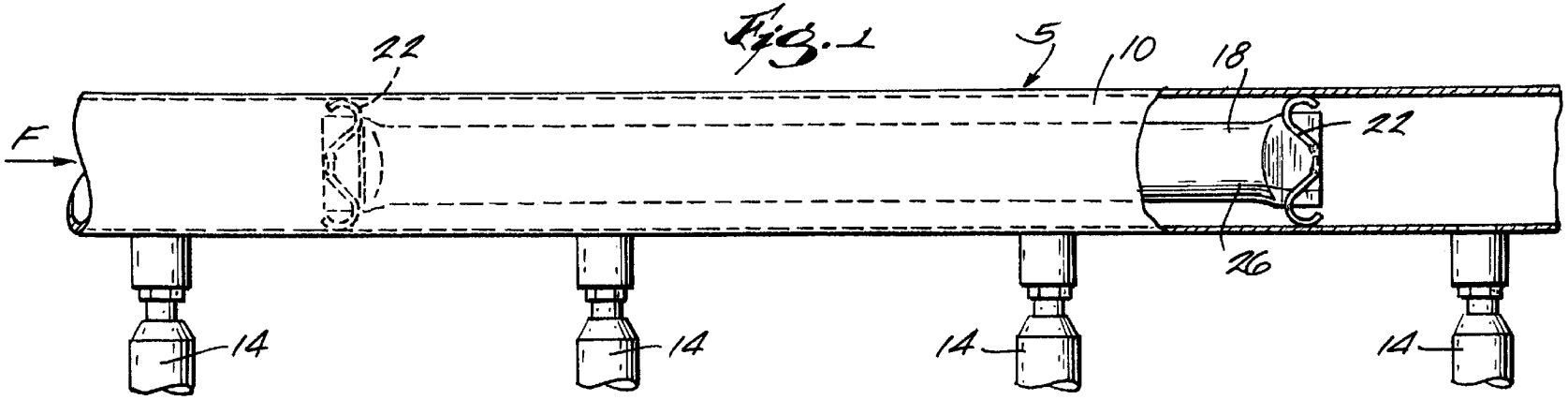
FIG. 1 illustrates a fuel rail having therein a damper element according to the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of"including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order.

DETAILED DESCRIPTION

FIG. 1 illustrates a fuel supply system 5 embodying the present invention. The fuel supply system 5 comprises a fuel rail tube 10 (also known as a fuel distributor tube or manifold). Fuel F flows in a generally known way into one end of the fuel rail tube 10, which serves to distribute the fuel among injection valves 14. In a return-type system, excess fuel emerges at the opposite end of the fuel rail tube 10 at a pressure regulator (not shown) or as back flow. In a dead-headed or returnless system, the fuel exits the fuel rail tube 10 only through the injectors 14. A suitable fuel supply system is shown and described, for example, in U.S. Pat. No. 5,575,262 to Rohde which is herein fully incorporated by reference.

Figure 4:
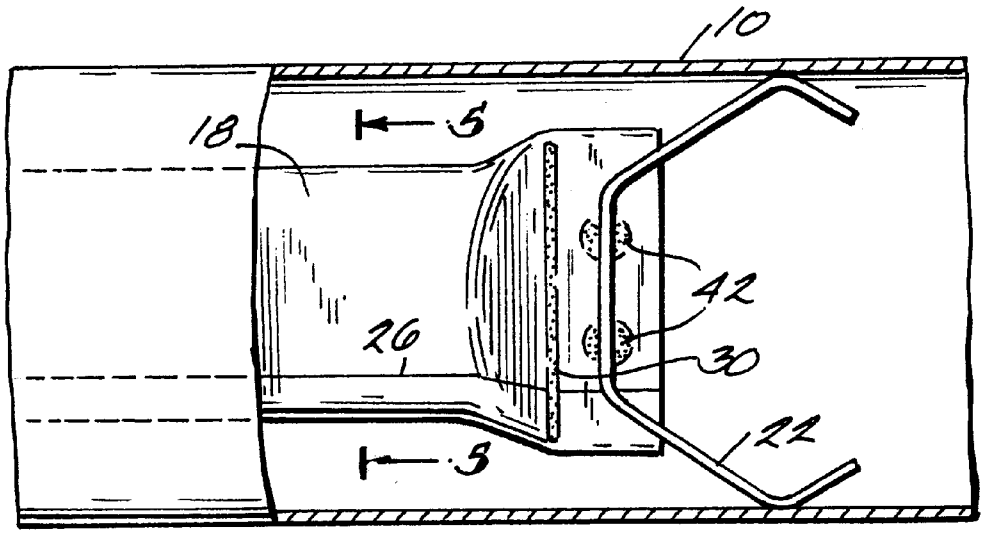
FIG. 4 illustrates a portion of another alternative damper element.

The fuel supply system 5 also comprises a damper element 18 located inside the fuel rail 10. Each end of the damper element 18 is preferably held in place within the fuel rail tube 10 with a support member or wire retainer 22 such as that shown in FIGS. 1 and 2, in FIG. 4 and in FIGS. 6 and 7. The wire retainer 22 may be formed into a variety of shapes, and is not limited to those shapes shown. Each retainer 22 is a formed wire which is made of a metal such as stainless steel or copper-coated stainless steel.

Figure 6:
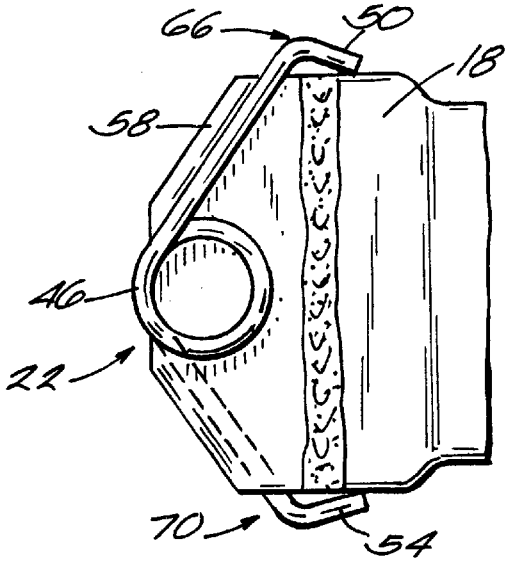
FIG. 6 illustrates a portion of a damper element with an alternative wire support member.
Figure 7:
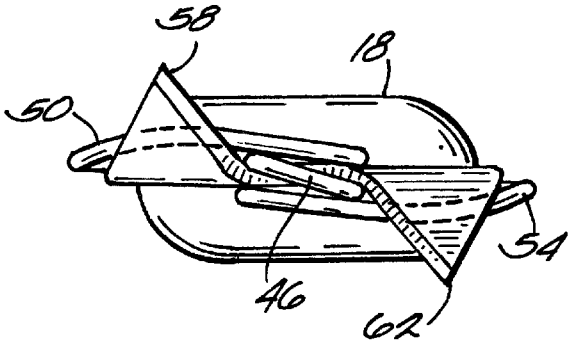
FIG. 7 is an end view of the damper element of FIG. 6.

The damper element 18 may be manufactured by first rolling a ribbon of metal (such as stainless steel) having a thickness in the range of 0.08 to 0.35 mm into a tube of circular cross-section. A longitudinal seam 26 is then welded (such as by plasma welding) to join the ends of the ribbon of metal. Then the tube is formed into a desired cross-sectional shape. The tube may then be cut to the desired length. Gas (such a helium) may optionally be introduced into a cavity or gas chamber 28 in the interior of the damper element 18. Then the ends are flattened and sealed with a weld 30 (such as by laser or resistance welding) to gas-tightly seal the chamber 28. The wire retainers 22 are then attached to the flattened ends of the tube such as by clipping, as seen in FIGS. 6 and 7, or by welding. Alternatively, the wire retainers are brazed into the flattened ends with only the addition of a suitable flux, the copper coating serving as the braze media.

Materials suited for the damper element 18 include metals such as steel. Stainless steel is preferred. A metallic damper provides advantages over customary plastic or elastomeric dampers because the metallic damper does not degrade in the fuel system, and its characteristics (such as elasticity) do not change as dramatically with changes in temperature. Specifically, a stainless steel construction provides damping performance in a wider temperature range than conventional elastomeric diaphragm dampers. Elastomeric dampers may become stiff at low temperatures with resulting diminished performance, and can degrade or significantly change damping characteristics at high temperatures. Thus, the damper element of the present invention provides good performance at both high and low ambient temperatures.

Further, the stainless steel construction offers resistance to even chemically-aggressive fuels. Conventional diaphragm dampers, or other dampers utilizing elastomeric components, are subject to swelling and degradation when exposed to chemically-aggressive fuels.

Due to the manufacturing process in which tube is rolled and welded together, the resulting damper element has a seam 26 along only one side of the damper element. The longitudinal seam 26 may be positioned at any location along the circumference of the damper element 18. Preferably, the seam does not bisect either side of the damper element 18 (i.e., is not on the centerline of the side or is not at the vertical mid-point) because the centerlines of the sides bear the greatest stress when the damper element 18 is formed. Likewise, preferably the seam 26 does not bisect the top or bottom of the damper element 18 because the centers of the top and bottom bear the greatest stress during operation. Most preferably, the longitudinal weld 26 is located about halfway in-between horizontal centerline and the vertical centerline.

Figure 3:
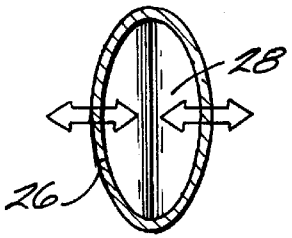
FIG. 3 illustrates an alternative cross-sectional shape of the damper element.
Figure 2:
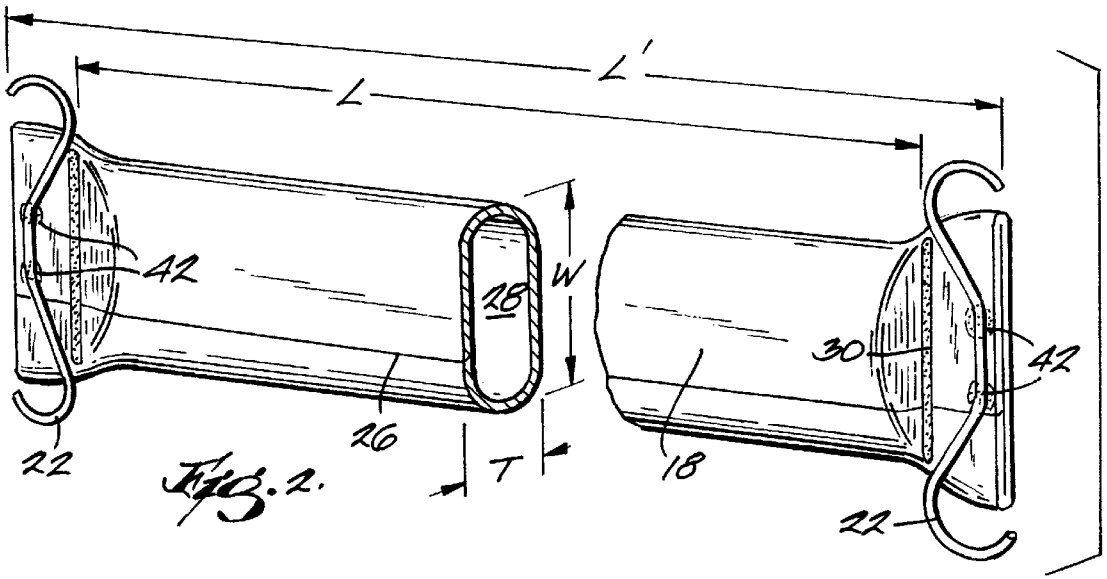
FIG. 2 is a perspective view of the damper element.
Figure 5:
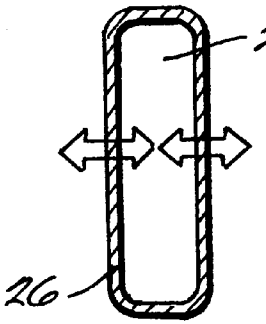
FIG. 5 is a cross-section view taken along line 5—5 in FIG. 4.

The desired cross-sectional shape may be that of an oval as shown, for example, in FIGS. 2 and 3; or a more rectangular shape as shown in FIG. 5; or any other desired shape. Preferably, the cross-section of the damper element 18 is not perfectly round, because a round damper element 18 would not compress effectively. Most preferably, the cross-section is oval. As is well-known, an oval or an ellipse has two foci and each end has a radius of curvature. In a preferred cross-sectional embodiment, as shown in FIG. 2, each end of the oval defines an arcuate surface that is preferably semi-circular in cross-section. The ends are linked by flat areas that provide better elasticity than a curved shape. The radius of curvature of the arcuate surfaces preferably equals half of the thickness T of the damper element 18. The radius is preferably greater than about 2.5 millimeters (mm) (resulting in a diameter and damper element thickness T greater than about 5 mm). A smaller radius tends to provide excessive stress which can lead to cracks in the damper element 18. The radius of curvature is preferably less than about 3.5 mm (resulting in a diameter and damper element thickness T less than about 7 mm). Larger diameters tend to deform undesirably under pressure after installation in the fuel system. A damper element thickness T of about 6 mm is preferred.

In a highly preferred embodiment as depicted in FIG. 2, the stainless steel tube diameter is 10.5 mm prior to deforming the tube into an oval (that is when the cross-section of the tube is circular), and the wall thickness is 0.25 mm. After forming the tube into an oval cross-section with flat areas as shown in FIG. 2, the damper element thickness T is 6 mm and the width W is 13.5 mm.

The end welds 30 serve to prevent loss of function of the damper element 18 which may occur if it were to fill with the fuel in which it is immersed. Also, the gas sealed within the chamber 28 may be used as a method of quality control. Preferably, the gas is helium so that helium detection may be employed to detect leaks in the gas-filled chamber 28 after the tube has been sealed.

The desired length of the damper element 18 may be easily and inexpensively varied to compensate for the particular individual dynamical behavior of the fuel rail tube 10. No special tooling (i.e., a new die or deep drawing tool) is required to shorten or elongate the damper element 18. The damper element 18 should be large enough to effectively absorb the undesirable compressive forces, and should be small enough to fit into a fuel rail tube 10. Referring to FIG. 2, by way of example, the damper element length L' is about 235 mm, and the length L of the damper element chamber 28 is about 228 mm.

Figure 8:
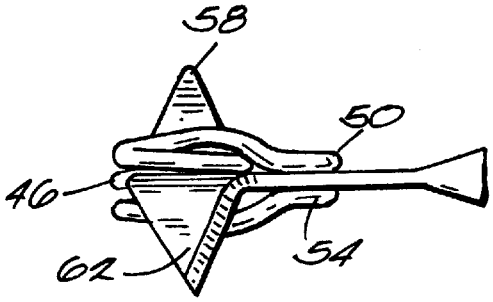
FIG. 8 is a side view of the damper element of FIG. 6.

As seen in FIGS. 6–8, each wire retainer 22 is preferably formed with a central coil 46 and legs 50, 54 extending from the coil 46. The coil 46 has at least two turns. The retainer 22 is attached to the flattened end of the damper element 18 by clipping the coil 46 on the tube such that the flattened end extends between two turns of the coil 46. The flattened end of the damper element 18 includes bent portions or flanges 58, 62 that hold the retainer 22 on the end of the damper element 18. The bent portion 58 is formed by bending a portion of the flattened end in one direction (upward in FIG. 7). The bent portion 62 is formed by bending a portion of the flattened end in the opposite direction (downward in FIG. 7). The coil 46 is clipped to the flattened end between the bent portions 58, 62 such that the retainer legs 50, 54 contact the bent portions 58, 62, respectively. To remove the retainer 22 from the damper element 18, the retainer legs 50, 54 must be deflected to pass over the bent portions 58, 62. The retainer legs 50, 54 are biased outwardly and have respective curved or engaging portions 66, 70 that engage the inside wall of the fuel rail tube 10.

Alternatively, the wire retainers 22 can be attached by welds 42 positioned outwardly of the end welds 30 to avoid rupturing the chamber 28. More preferably, the wire retainers 22 are attached near the end of the damper element 18 as shown in FIG. 2.

The location of the device inside the fuel rail 10 offers a less severe failure mode. In other words, in the event of failure, this embodiment does not result in an external fuel leakage to the atmosphere. Certain failure modes in conventional diaphragm dampers, and other devices, tend to result in an external fuel leak.

As shown in FIGS. 3 and 5, as the fuel injectors displace volume, the sidewalls of the damper element 18 flex to absorb the compressive forces.

The damper element 18 is a uniquely shaped metallic hydraulic damper preferably having retaining features, and optimized volumetric compliance and strength. Volumetric compliance is the change in gas-filled chamber 28 volume as a function of applied pressure. Optimization of this characteristic to a predetermined value, constant through the operating pressure range, may be achieved by controlling design features such as cross-sectional shape, wall thickness, and material. The strength may be optimized for specific applications through the use of structural analysis such as Finite Element Analysis (FEA), as well as experimental data.

The shape of the damper, as well as its retaining features, make it well suited for installation in rigid tubing such as a fulel rail.

The cross-section and wall thickness of the device may be optimized for damping characteristics identified by the volume as a function of external pressure, and for resistance to device failure when subjected to repeated pressure cycling from 0 atmosphere (atm) gauge to system pressure of approximately 4 atm gauge. The damper element is preferably constructed from thin wall (0.08 to 0.35 mm) stainless steel.

What is claimed is:

1. A fuel supply system for a fuel-injected internal combustion engine, the system comprising:

a fuel rail for communication with one or more fuel injectors; and an elongated damper disposed within said fuel rail, said damper having a single longitudinal weld seam;

wherein said damper includes a top wall portion having a centerline and a sidewall portion having a centerline, and wherein said seam is positioned between said centerlines of said top and sidewall portions.

2. The fuel supply system of claim 1, wherein said seam is positioned halfWay between said centerlines.

3. A fuel supply system for a fuel-injected internal combustion engine, the system comprising:

a fuel rail for communication with one or more fuel injectors; and an elongated damper disposed within said fuel rail, said damper having a single longitudinal weld seam, a thickness, and arcuate top and bottom wall portions, wherein the radius of curvature of the top and bottom wall portions is approximately equal to half of said thickness, wherein said radius of curvature is between about 2.5 mm and about 3.5 mm, wherein said thickness is about 6 mm, wherein said damper has a wall thickness of about 0.25 mm, wherein said damper has an overall length of about 235 mm, and wherein said damper defines a chamber having a length of about 228 mm.

4. A method for manufacturing a damper element for use in a fuel rail, the method comprising the steps of:

(a) providing an elongated ribbon of metal;

(b) rolling the ribbon into a tube;

(c) welding a single longitudinal seam of the tube; and (d) sealing the ends of the tube;

wherein step (a) includes providing a ribbon of stainless steel having a thickness in the range of 0.08 to 0.35 mm.

5. A method for manufacturing a damper element for use in a fuel rail, the method comprising the steps of:

(a) providing an elongated ribbon of metal;

(b) rolling the ribbon into a tube;

(c) welding a single longitudinal seam of the tube; and (d) sealing the ends of the tube;

wherein step (b) includes forming a tube with top wall and sidewall portions, and wherein step (c) includes welding a seam between the centerlines of the top and sidewall portions.

6. The method of claim 5, wherein said seam is positioned halfway between said centerlines.

7. A fuel supply system for a fuel-injected internal combustion engine, the system comprising:

a fuel rail for communication with one or more fuel injectors; and an elongated damper disposed within said fuel rail, said damper having a single longitudinal weld seam, a width, a thickness, and opposing arcuate wall portions spaced apart in the direction of said width, said width of said damper being greater than said thickness such that the damper has an elongated cross section;

wherein each of said opposing arcuate wall portions has a radius of curvature, wherein said radius of curvature of each of said opposing arcuate wall portions is approximately equal to half of said thickness, and wherein said radius of curvature of each of said opposing arcuate wall portions is between about 2.5 mm and about 3.5 mm.

8. The fuel supply system of claim 7, wherein said thickness is less than about 7 mm.

9. The fuel supply system of claim 8, wherein said thickness is about 6 mm.

10. The fuel supply system of claim 7, wherein said damper has a wall thickness of between approximately 0.08–0.35 mm.

11. The fuel supply system of claim 10, wherein said damper has a wall thickness of between approximately 0.20–0.30 mm.

12. The fuel supply system of claim 11, wherein said damper has a wall thickness of about 0.25 mm.

13. The fulel supply system of claim 7, wherein said damper has an overall length of about 235 mm, and wherein said damper defines a chamber having a length of about 228 mm.

14. The fuel supply system of claim 7, wherein said damper has an overall length and defines a chamber having a length that is approximately 7 mm less than the overall length.

15. The fuel supply system of claim 7, further comprising at least one support member supporting said elongated damper within said fuel rail.

16. The fuel supply system of claim 15 wherein said support member includes a stainless steel wire interconnected with said damper.

17. The fuel supply system of claim 7, wherein said elongated damper includes opposite closed ends and defines a gas-tightly sealed cavity containing a gas.

18. The fuel supply system of claim 7, wherein the opposing arcuate portions are bisected by a first plane and wherein the damper further includes opposing sidewall portions that are spaced apart in the direction of said thickness and that are bisected by a second plane that is substantially perpendicular to said first plane, and wherein said seam is positioned between said first and second planes.

19. The fuel supply system of claim 18, wherein said seam is positioned approximately halfway between said first and second planes.

20. The fuel supply system of claim 7, wherein said damper has an oval cross-section.

* * * * *